US010935302B2

(12) United States Patent
Shi et al.

(10) Patent No.: US 10,935,302 B2
(45) Date of Patent: Mar. 2, 2021

(54) AIR VOLUME ADJUSTMENT DEVICE FOR REFRIGERATOR

(71) Applicant: QINGDAO HAIER JOINT STOCK CO., LTD., Qingdao (CN)

(72) Inventors: Honghai Shi, Qingdao (CN); Dongya Yang, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 142 days.

(21) Appl. No.: 16/473,239

(22) PCT Filed: Dec. 21, 2017

(86) PCT No.: PCT/CN2017/117604
§ 371 (c)(1),
(2) Date: Jun. 24, 2019

(87) PCT Pub. No.: WO2018/113712
PCT Pub. Date: Jun. 28, 2018

(65) Prior Publication Data

US 2019/0323757 A1 Oct. 24, 2019

(30) Foreign Application Priority Data

Dec. 22, 2016 (CN) ..... 201611200716.1

(51) Int. Cl.
*F25D 17/00* (2006.01)
*F25D 17/04* (2006.01)
*F25D 17/06* (2006.01)

(52) U.S. Cl.
CPC ..... *F25D 17/045* (2013.01); *F25D 17/065* (2013.01)

(58) Field of Classification Search
CPC ..... F25B 2600/0251; F25B 2600/112; F25D 17/045; F25D 17/065; F25D 2317/067; F25D 23/065
See application file for complete search history.

(56) References Cited

U.S. PATENT DOCUMENTS 4,614,092 A 9/1986 Kim et al.
4,967,568 A * 11/1990 Harnden, Jr. et al. ..... F25D 29/00 62/155

(Continued)

FOREIGN PATENT DOCUMENTS

CN 2549408 Y 5/2003
CN 2739542 Y 11/2005

(Continued)

*Primary Examiner* — Filip Zec
(74) *Attorney, Agent, or Firm* — Cheng-Ju Chiang

(57) ABSTRACT

An air volume adjustment device for a refrigerator comprises a fan, a baffle, an operating knob and a potentiometer. The baffle is disposed between a first air inlet cavity of a first compartment and a second air inlet cavity of a second compartment. The baffle is capable of moving among a plurality of positions to adjust the volume of air entering the first air inlet cavity and the second air inlet cavity. The operating knob and the potentiometer are connected to the front side and the rear side of the baffle respectively. The potentiometer is connected to a controller. The operating knob operably drives the baffle to move. The potentiometer transmits an electrical signal corresponding to a position of the baffle to the controller. The controller controls a rotational speed of the fan or controls the compressor to be started up or shut down.

10 Claims, 3 Drawing Sheets

(56) References Cited

U.S. PATENT DOCUMENTS

| | | | | |
|---|---|---|---|---|
| 5,758,512 | A * | 6/1998 | Peterson et al. | F25D 17/065 62/407 |
| 5,899,083 | A * | 4/1999 | Peterson et al. | F25D 17/045 62/186 |
| 10,281,190 | B2 * | 5/2019 | Besore et al. | F25D 17/065 62/408 |
| 2009/0113923 | A1 * | 5/2009 | Young | F25D 17/065 62/441 |

FOREIGN PATENT DOCUMENTS

| | | | |
|---|---|---|---|
| CN | 202281442 | U | 6/2012 |
| CN | 203949429 | U | 11/2014 |
| CN | 204555502 | U | 8/2015 |
| CN | 104879988 | A | 9/2015 |
| CN | 104956167 | A | 9/2015 |
| CN | 105222469 | A | 1/2016 |
| CN | 105758093 | A | 7/2016 |
| CN | 205641739 | U | 10/2016 |
| CN | 205690797 | U | 11/2016 |
| CN | 106679287 | A | 5/2017 |
| FR | 2599480 | A1 | 12/1987 |
| JP | H1-127880 | A | 5/1989 |
| JP | H1-203876 | A | 8/1989 |
| WO | 2011/081498 | A2 | 7/2011 |

* cited by examiner

AIR VOLUME ADJUSTMENT DEVICE FOR REFRIGERATOR

The present application is a 35 U.S.C. § 371 National Phase conversion of International (PCT) Patent Application No. PCT/CN2017/117604, filed on Dec. 21, 2017, which claims priority to Chinese Patent Application No. 201611200716.1, filed on Dec. 22, 2016 and titled "Air Volume Adjustment Device for Refrigerator", which is incorporated herein by reference in its entirety. The PCT International Patent Application was filed and published in Chinese.

FIELD OF THE INVENTION

The present invention relates to the field of home appliances, and in particular, to an air volume adjustment device for a refrigerator.

BACKGROUND OF THE INVENTION

In the prior art, refrigerators generally refer to single-door refrigerators, double-door dual-temperature refrigerators, three-door and three-temperature refrigerators, cabinet type multi-door refrigerators and the like, and are generally provided with independent outer doors of freezing compartments and refrigerating compartments, so as to realize separate storage according to different storage temperatures. The refrigeration principles of these refrigerator-freezers are divided into a direct-cooled type and an air-cooled type. The direct-cooled refrigeration system generally uses a solenoid valve to control the flow direction of a refrigerant and supplies the refrigerant to an evaporator of each refrigerating (freezing) compartment, such that each space is cooled to a desired temperature. The air-cooled refrigerator-freezer needs corresponding air ducts for supplying air to each space.

A typical refrigerator provided with two or more doors comprises at least one freezing compartment and a plurality of refrigerating compartments. For some users with different needs, refrigerator compartments can achieve free switching among a freezing function, a soft freezing function and a refrigerating function. The existing control solution generally uses a plurality of fans to achieve air volume distribution, and the cost is high. Or the air volume of a freezing air duct of the refrigerator is controlled by an electric air door, and the parts such as a main control board and a temperature sensor need to be used together to control the opening and closing angles of the electric air door by a program. The whole structure is complicated, expensive, and difficult to maintain.

SUMMARY OF THE INVENTION

An objective of the present invention is to provide an air volume adjustment device for a refrigerator. The air volume adjustment device is relatively low in cost and capable of realizing free switching of functions among a plurality of compartments for the refrigerator.

To fulfill said objective of the present invention, the present invention provides an air volume adjustment device for a refrigerator. The refrigerator comprises a refrigerator body, a compressor and an evaporator, wherein: a first compartment and a second compartment are defined in the refrigerator body; a first air inlet cavity communicated with the first compartment and a second air inlet cavity communicated with the second compartment are disposed behind the first compartment and the second compartment respectively; the compressor is disposed on the bottom of the refrigerator body; the evaporator is disposed in an evaporator cavity of the refrigerator body and is capable of supplying cold to the first compartment and the second compartment; the air volume adjustment device is disposed behind the first compartment and the second compartment and comprises a fan and a baffle; the baffle is disposed between the first air inlet cavity and the second air inlet cavity; the fan is capable of introducing cold air from the evaporator into the first air inlet cavity and the second air inlet cavity; the baffle is capable of moving among a plurality of positions to adjust the volume of air entering the first air inlet cavity and the second air inlet cavity; the refrigerator further comprises a controller connected to the compressor and the air volume adjustment device; the air volume adjustment device further comprises an operating knob and a potentiometer which are connected to the front side and the rear side of the baffle respectively; the operating knob is disposed inside one of the first compartment and the second compartment; the potentiometer is connected to the controller; the operating knob operably drives the baffle to move; the potentiometer transmits an electrical signal corresponding to a position of the baffle to the controller; and the controller controls a rotational speed of the fan or controls the compressor to be started up or shut down.

As an improvement of an embodiment of the present invention, the operating knob is configured as a rotary knob which drives the baffle to rotate among the plurality of positions.

As an improvement of an embodiment of the present invention, the first compartment is configured as a refrigerating compartment; the second compartment is configured as a freezing compartment; and the air volume adjustment device is disposed behind the freezing compartment.

As an improvement of an embodiment of the present invention, the refrigerator body further comprises a front cover plate disposed on the back of the freezing compartment and a rear cover plate connected to the front cover plate; and the first air inlet cavity and the second air inlet cavity are disposed between the front cover plate and the rear cover plate.

As an improvement of an embodiment of the present invention, the potentiometer is mounted on the rear cover plate.

As an improvement of an embodiment of the present invention, the operating knob is capable of driving the baffle to move among at least three positions, such that the refrigerator can be switched among at least three modes; in the first position, the volume of air entering the refrigerating compartment is substantially equal to that entering the freezing compartment, and the refrigerator operates in a conventional mode; in the second position, the volume of air entering the refrigerating compartment is less than that entering the freezing compartment, and the refrigerator operates in a fast-cooling mode; and in the third position, the volume of air entering the refrigerating compartment is greater than that entering the freezing compartment, and the refrigerator operates in a freezing-to-refrigerating mode.

As an improvement of an embodiment of the present invention, in the fast-cooling mode, the controller controls the rotational speed of the fan to be increased by 10% compared to the conventional mode; and in the freezing-to-refrigerating mode, the controller controls the rotational speed of the fan to be reduced by 10% compared to the conventional mode.

As an improvement of an embodiment of the present invention, the air volume adjustment device further comprises a columnar body which penetrates through the front cover plate and the rear cover plate; the baffle is fixed on the columnar body; and the operating knob and the potentiometer are connected to two ends of the columnar body respectively.

As an improvement of an embodiment of the present invention, a rear plate of the freezing compartment is disposed on the front part of the front cover plate; and a freezing air duct which is communicated with the freezing compartment is disposed between the front cover plate and the rear plate of the freezing compartment.

As an improvement of an embodiment of the present invention, a foam thermal-insulating layer is disposed between the front cover plate and the rear plate of the freezing compartment; and the freezing air duct is positioned between the front cover plate and the foam thermal-insulating layer.

Compared with the prior art, the present invention has the following beneficial effects: the refrigerator realizes free switching among the functions of a plurality of compartments of the refrigerator by an integrated structure including the mechanical rotary knob, the baffle and the potentiometer, thereby meeting the demands of a user on different functions of the compartments and meeting the maximum storage demand of the user on the refrigerator.

DETAILED DESCRIPTION OF THE EMBODIMENTS

The present invention will be described in detail below with reference to the specific embodiments shown in the accompanying drawings. However, these embodiments are not intended to limit the present invention, and modifications in structures, methods, or functions made by those common skilled in the art according to these embodiments are all included in the protection scope of the present invention.

A preferred refrigerator of the present invention comprises a refrigerator body defining two cooling compartments, that is, a refrigerating compartment and a freezing compartment respectively. In general, the refrigerating compartment and the freezing compartment are disposed from top to bottom. Of course, three cooling compartments disposed from top to bottom or other configurations are also available. In the present embodiment, a direction in which the refrigerating compartment and the freezing compartment are disposed from top to bottom is defined as a height direction of the refrigerator. The directions in which a user opens the refrigerator facing a refrigerator door and opposing the refrigerator door are defined as front and back directions of the refrigerator. A direction perpendicular to the height direction and the thickness direction is defined as a width direction of the refrigerator.

The refrigerator is further provided with a compressor and an evaporator. The compressor is disposed on the bottom of the refrigerator body. The evaporator is disposed in an evaporator cavity above the freezing compartment of the refrigerator body and used for supplying cold to the freezing compartment and the refrigerating compartment. A defroster is disposed on the lower part of the evaporator. The compressor is disposed at the rear side of the bottom of the refrigerator. The evaporator may be any known evaporator, such as one of a fin evaporator, a wire-tube evaporator, a blow-up evaporator, and a plate-tube evaporator. In the present embodiment, the refrigerator forms a compression and refrigeration cycle system through the compressor, a condenser (not shown in drawings) and the evaporator.

Figure 1:
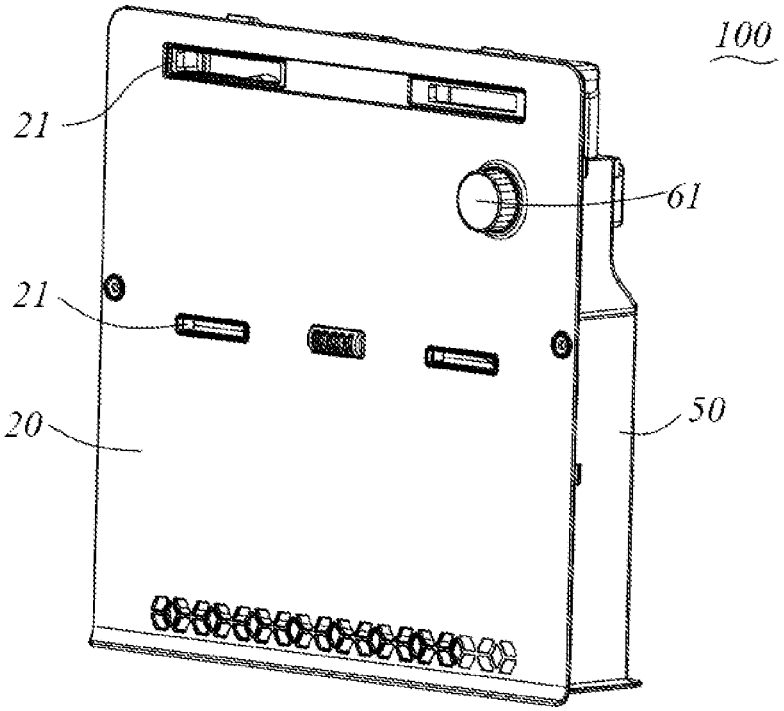
FIG. 1 is a perspective view of an air duct component of a refrigerator in a preferred embodiment of the present invention, in which the front of the air duct component is illustrated.
Figure 2:
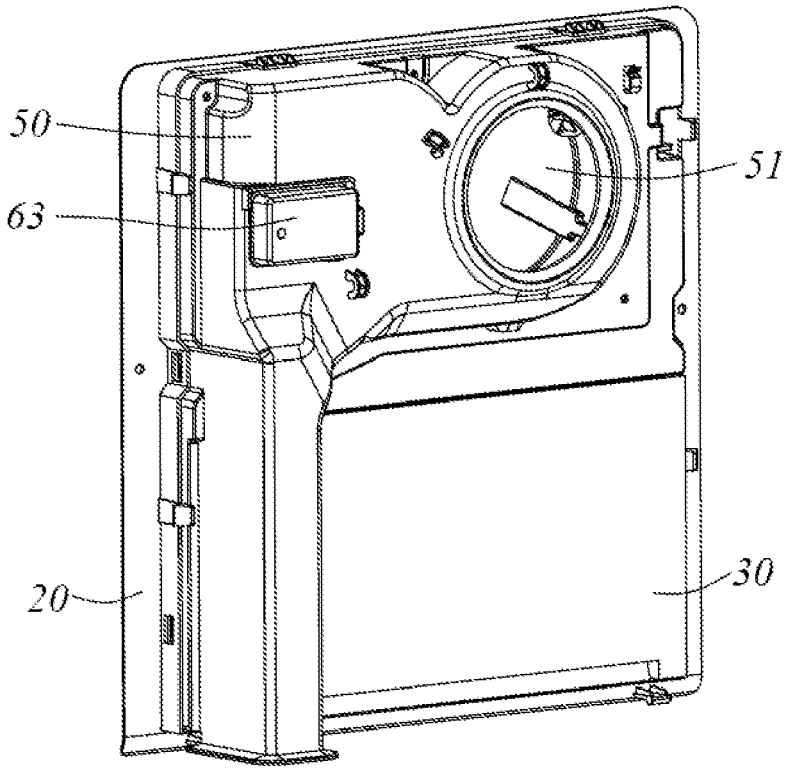
FIG. 2 is a perspective view of the air duct component in FIG. 1, in which the back of the air duct component is illustrated.
Figure 3:
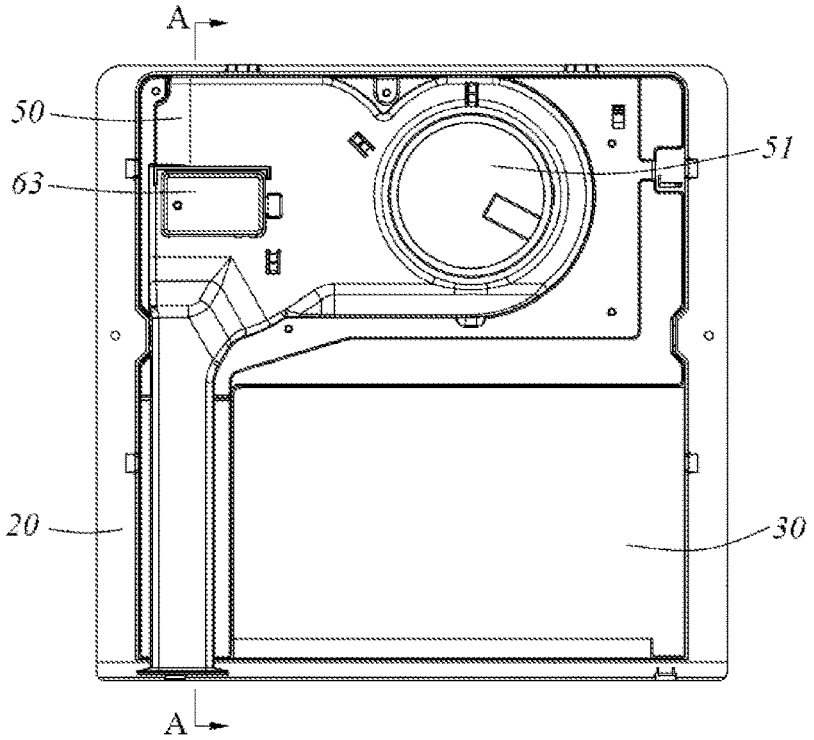
FIG. 3 is a front view of the air duct component in FIG. 2.
Figure 4:
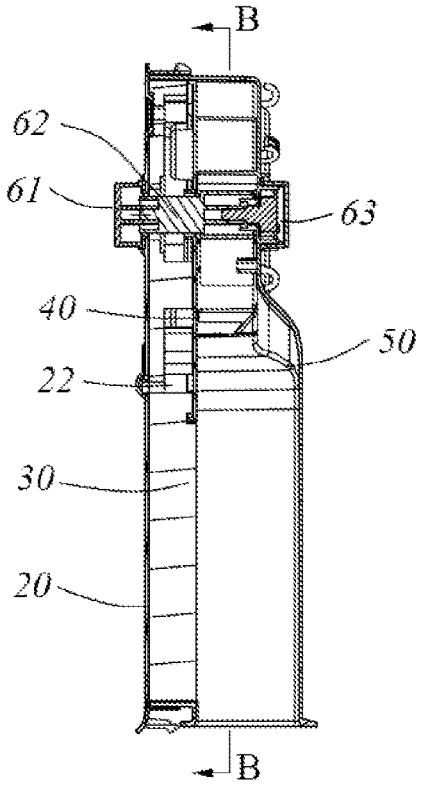
FIG. 4 is a sectional view along a line A-A in FIG. 3.
Figure 5:
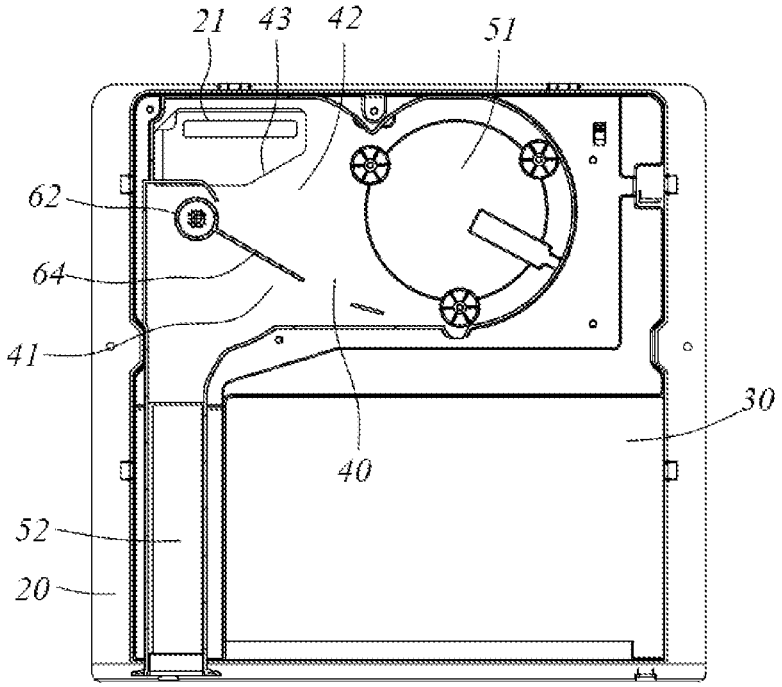
FIG. 5 is a sectional view along a line B-B in FIG. 4.

As shown in FIGS. 1 to 5, in the present embodiment, the refrigerator further comprises an air duct component 100 which is disposed behind the refrigerating compartment and the freezing compartment. The air duct component 100 comprises a rear plate 20 disposed behind the freezing compartment, and a front cover plate 40 and a rear cover plate 50 which are connected to the rear plate. A fan accommodating cavity 51 for accommodating a fan is formed between the front cover plate 40 and the rear cover plate 50. A first air inlet cavity 41 (i.e., a refrigerating air inlet cavity) communicated with the refrigerating compartment and a second air inlet cavity 42 (i.e., a freezing air inlet cavity) communicated with the freezing compartment are formed at the air outlets of the fan. A freezing air duct 22 is disposed between the front cover plate 40 and the rear plate 20 of the freezing compartment. The rear plate 20 of the freezing compartment is further provided with an air vent 21. The front cover plate 40 is provided with a freezing air duct air inlet 43 which is communicated with the freezing air duct 22. Cold air entering the second air inlet cavity 42 may enter the freezing air duct 22 through the freezing air duct air inlet 43 and then enter the freezing compartment through the air vent 21. A thermal-insulating layer 30 may also be disposed between the front cover plate 40 and the rear plate 20 of the freezing compartment so as to reduce the cold loss and improve the thermal insulation effect. A foam thermal-insulating layer is preferably used as the thermal-insulating layer. A refrigerating air inlet duct 52 is disposed between the rear cover plate 50 and the thermal-insulating layer 30. Cold air entering the first air inlet cavity 41 may enter the refrigerating compartment through the refrigerating air inlet duct 52.

The air duct component 100 comprises an air volume adjustment device. The air volume adjustment device comprises a fan (not shown) and a baffle 64 disposed at one side of the fan. The fan is capable of introducing cold air from the evaporator into the first air inlet cavity 41 and the second air inlet cavity 42. The baffle 64 is positioned between the first air inlet cavity 41 and the second air inlet cavity 42. The baffle 64 is capable of moving among a plurality of positions to adjust the volume of air entering the first air inlet cavity 41 and the second air inlet cavity 42, thereby controlling the volume of air entering the refrigerating compartment and the freezing compartment.

Specifically, an operating knob 61 and a potentiometer 63 are connected to the front side and the rear side of the baffle 64 respectively. The operating knob 61 is disposed inside the freezing compartment. The potentiometer 63 is disposed on the rear cover plate 50. The operating knob 61 is capable of driving the baffle 64 to rotate. The baffle 64 rotates, such that the potentiometer 63 is capable of outputting a signal corresponding to a position of the baffle 64 to a controller of the refrigerator. The controller of the refrigerator controls a rotational speed of the fan or controls the compressor to be started up or shut down. The air volume adjustment device further comprises a columnar body 62 which penetrates through the front cover plate 40 and the rear cover plate 50. The baffle 64 is fixed on the columnar body 62. The operating knob 61 and the potentiometer 63 are connected to two ends of the columnar body 62 respectively.

Preferably, the operating knob 61 is configured as a rotary knob which drives the baffle 64 to rotate among the plurality of positions. The rear plate 20 of the freezing compartment may be printed with line marks with gear scales or marked with names of gears, or the rotary knob is printed with digits. These line marks may help the user understand the adjusted gears.

In the course of realizing free switching of the functions of a plurality of compartments, the volume of air entering the refrigerating compartment and the freezing compartment may be controlled by adjusting the position of the baffle 64. By using the characteristic of stepless adjustment of the resistance of the potentiometer 63 from small values to large values, the rotary knob drives the baffle to different gears to output different signals to the controller. The controller learns the position of the gear set by the user so as to control the rotational speed of the fan or control the compressor to be started up or shut down according to set control rules, such that the functions of the refrigerator meet the requirements of the user.

Specifically, the baffle 64 is assumed to have six positions a, b, c, d, e and f, the startup and shutdown points of the compressor, which are matched with these six positions, and the rotational speed of the fan are set as A, B, C, D, E and F respectively. When the user selects the gear of the baffle to be in the position a, the controller can analyze the corresponding startup and shutdown points according to the angle of the baffle 64 corresponding to the position a, thereby determining whether the compressor needs to be started up. If the compressor does not need to be started up, the compressor is shut down. If the compressor needs to be started up, the shutdown point and the rotational speed setting A of the fan are matched. That is, the startup and shutdown of the compressor and the rotational speed of the fan are controlled according to the program A, and then the compressor is shut down if the requirement on the shutdown point in the program A is met.

By taking the fact that the rotary knob drives the baffle to move among three positions as an example for explanation, in the first position, the volume of air entering the refrigerating compartment is substantially equal to that entering the freezing compartment, a ratio of the volume of air entering the refrigerating compartment to the volume of air entering the freezing compartment is 1:1 or so, and therefore, a conventional mode can be set. In the second position, the volume of air entering the refrigerating compartment is less than that entering the freezing compartment, a ratio of the volume of air entering the refrigerating compartment to the volume of air entering the freezing compartment ranges from 2:8 to 4:6, and therefore a fast-cooling mode can be set. In the third position, the volume of air entering the refrigerating compartment is greater than that entering the freezing compartment, a ratio of the volume of air entering the refrigerating compartment to the volume of air entering the freezing compartment ranges from 6:4 to 8:2, and therefore a freezing-to-refrigerating mode can be set. Correspondingly, the rotational speed of the fan may be increased in the fast-cooling mode; for example, the rotational speed of the fan is increased by about 10% compared to the conventional mode. The rotational speed of the fan may be reduced in the freezing-to-refrigerating mode; for example, the rotational speed of the fan is reduced by about 10% compared to the conventional mode.

It should be understood that although the description is explained according to the above embodiments, each embodiment may not only include one independent technical solution. The presentation manner of the description is only for the sake of clarity. Those skilled in the art should take the description as an integral part. The technical solutions in respective embodiments may be combined properly to form other embodiments understandable by those skilled in the art.

The above detailed explanations only illustrate the feasible embodiments of the present invention, and are not intended to limit the protection scope of the present invention. Equivalent embodiments or modifications within the scope and spirit of the present invention shall be embraced by the protection scope of the present invention.

What is claimed is:

1. An air volume adjustment device for a refrigerator, wherein the refrigerator comprises a refrigerator body, a compressor and an evaporator, wherein:

a first compartment and a second compartment are defined in the refrigerator body; a first air inlet cavity communicated with the first compartment and a second air inlet cavity communicated with the second compartment are disposed behind the first compartment and the second compartment respectively;

the compressor is disposed on the bottom of the refrigerator body;

the evaporator is disposed in an evaporator cavity of the refrigerator body and is capable of supplying cold to the first compartment and the second compartment;

the air volume adjustment device is disposed behind the first compartment and the second compartment, and comprises a fan and a baffle; the baffle is disposed between the first air inlet cavity and the second air inlet cavity; the fan is capable of introducing cold air from the evaporator into the first air inlet cavity and the second air inlet cavity; the baffle is capable of moving among a plurality of positions to adjust the volume of air entering the first air inlet cavity and the second air inlet cavity; the refrigerator further comprises a controller connected to the compressor and the air volume adjustment device; and the air volume adjustment device is characterized by further comprising an operating knob and a potentiometer which are connected to the front side and the rear side of the baffle respectively;

the operating knob is disposed inside one of the first compartment and the second compartment; the potentiometer is connected to the controller; the operating knob operably drives the baffle to move; the potentiometer transmits an electrical signal corresponding to a position of the baffle to the controller; and the controller controls a rotational speed of the fan or controls the compressor to be started up or shut down.

2. The air volume adjustment device according to claim 1, wherein the operating knob is configured as a rotary knob which drives the baffle to rotate among the plurality of positions.

3. The air volume adjustment device according to claim 1, wherein the first compartment is configured as a refrigerating compartment; the second compartment is configured as a freezing compartment; and the air volume adjustment device is disposed behind the freezing compartment.

4. The air volume adjustment device according to claim 3, wherein the refrigerator body further comprises a front cover plate disposed on the back of the freezing compartment and a rear cover plate connected to the front cover plate; and the first air inlet cavity and the second air inlet cavity are disposed between the front cover plate and the rear cover plate.

5. The air volume adjustment device according to claim 4, wherein the potentiometer is mounted on the rear cover plate.

6. The air volume adjustment device according to claim 3, wherein the operating knob is capable of driving the baffle to move among at least three positions, such that the refrigerator can be switched among at least three modes; in the first position, the volume of air entering the refrigerating compartment is approximately equal to that entering the freezing compartment, and the refrigerator operates in a conventional mode; in the second position, the volume of air entering the refrigerating compartment is less than that entering the freezing compartment, and the refrigerator operates in a fast-cooling mode; and in the third position, the volume of air entering the refrigerating compartment is greater than that entering the freezing compartment, and the refrigerator operates in a freezing-to-refrigerating mode.

7. The air volume adjustment device according to claim 6, wherein in the fast-cooling mode, the controller controls the rotational speed of the fan to be increased by 10% compared to the conventional mode; and in the freezing-to-refrigerating mode, the controller controls the rotational speed of the fan to be reduced by 10% compared to the conventional mode.

8. The air volume adjustment device according to claim 4, wherein the air volume adjustment device further comprises a columnar body which penetrates through the front cover plate and the rear cover plate; the baffle is fixed on the columnar body; and the operating knob and the potentiometer are connected to two ends of the columnar body respectively.

9. The air volume adjustment device according to claim 4, wherein a rear plate of the freezing compartment is disposed on the front part of the front cover plate; and a freezing air duct which is communicated with the freezing compartment is disposed between the front cover plate and the rear plate of the freezing compartment.

10. The air volume adjustment device according to claim 9, wherein a foam thermal-insulating layer is disposed between the front cover plate and the rear plate of the freezing compartment; and the freezing air duct is positioned between the front cover plate and the foam thermal-insulating layer.

* * * * *